US008197100B2

(12) United States Patent
Kim

(10) Patent No.: US 8,197,100 B2
(45) Date of Patent: Jun. 12, 2012

(54) LED LIGHTING DEVICE

(75) Inventor: Young Ju Kim, Seoul (KR)

(73) Assignees: Easy Eco Inc., Ansan (KR); Byung Hyun Min, Ansan (KR)

( * ) Notice: Subject to any disclaimer, the term of this patent is extended or adjusted under 35 U.S.C. 154(b) by 0 days.

(21) Appl. No.: 12/880,020

(22) Filed: Sep. 10, 2010

(65) Prior Publication Data

US 2011/0037412 A1 Feb. 17, 2011

Related U.S. Application Data

(63) Continuation of application No. PCT/KR2009/001173, filed on Mar. 10, 2009.

(30) Foreign Application Priority Data

Mar. 10, 2008 (KR) ..... 10-2008-0022216

(51) Int. Cl.
*F21V 29/00* (2006.01)

(52) U.S. Cl. ..... 362/294; 362/326

(58) Field of Classification Search ..... 362/294, 362/800, 326; 257/98, 100, 722
See application file for complete search history.

(56) References Cited

U.S. PATENT DOCUMENTS

| | | | | |
|---|---|---|---|---|
| 6,787,999 | B2 * | 9/2004 | Stimac et al. | 315/51 |
| 7,434,959 | B1 * | 10/2008 | Wang | 362/249.01 |
| 7,527,397 | B2 * | 5/2009 | Li | 362/294 |
| 7,703,951 | B2 * | 4/2010 | Piepgras et al. | 362/373 |
| 2006/0262544 | A1 * | 11/2006 | Piepgras et al. | 362/373 |

FOREIGN PATENT DOCUMENTS

| | | | |
|---|---|---|---|
| CN | 1753192 | A | 3/2006 |
| CN | 101089461 | A | 12/2007 |
| JP | 2006-310138 | A | 11/2006 |
| KR | 20-0424053 | Y1 | 8/2006 |
| KR | 10-20080005136 | A | 1/2008 |

OTHER PUBLICATIONS

Written Opinion dated Sep. 30, 2009 of corresponding PCT Application No. PCT/KR2009/001173 filed on Mar. 10, 2009—4 pages.
Search Report dated Sep. 30, 2009 of corresponding PCT Application No. PCT/KR2009/001173 filed on Mar. 10, 2009—3 pages.

* cited by examiner

*Primary Examiner* — Ali Alavi
(74) *Attorney, Agent, or Firm* — Knobbe Martens Olson & Bear LLP

(57) ABSTRACT

A LED lighting device enables the assembly of one or more LED products in a variety of structures for a broad range of applications. In particular, one or more prefabricated individual water-resistant LED products are assembled in an attachable/detachable fixing frame in a variety of structures for use in a broad range of applications which include street lights, security lighting, tunnel lights, floodlights, etc. A further advantage of a LED lighting device is that it can be conveniently used with AC power, without the use of an AC/DC adapter or a stabilizer.

4 Claims, 5 Drawing Sheets

LED LIGHTING DEVICE

CROSS-REFERENCE TO RELATED PATENT APPLICATIONS

This application is a continuation application under 35 U.S.C. §365(c) of International Application No. PCT/KR2009/001173, filed Mar. 10, 2009 designating the United States. International Application No. PCT/KR2009/001173 was published as WO2009/0113788 A2 on Sep. 17, 2009. This application further claims the benefit of the earlier filing date under 35 U.S.C. §365(b) of Korean Patent Application No. 10-2008-0022216 filed Mar. 10, 2008. This application incorporates herein by reference the International Application No. PCT/KR2009/001173 including the International Publication No. WO2009/0113788 A2 and the Korean Patent Application No. 10-2008-0022216 in their entirety.

BACKGROUND

1. Technical Field

The present disclosure relates to light emitting diode (LED) lighting devices and, more particularly, to LED lighting devices, which enable the assembly of one or more LED products into a variety of structures for use in a broad range of applications including street lights, security lighting, tunnel lights, floodlights, etc.

2. Background Art

Generally, light emitting diodes (LEDs) are developed based on characteristics of a compound semiconductor emitting light upon application of current thereto, and have a smaller size and longer lifespan than other light sources while exhibiting excellent efficiency in converting electrical energy into light.

Recent advances in semiconductor technology have enabled commercialization of a white LED having high brightness and a variety of lighting devices using the white LED have been introduced.

In particular, various research has been actively conducted into development of an LED lighting module capable of illuminating a sufficiently large area through high-density integration of LED devices in series or parallel to increase the degree of luminous intensity per unit area, namely, brightness, to several thousand cd/cm2 or more.

However, an increase in integrated density of LEDs leads to an increase in the amount of heat generated per unit area, causing damage to the LEDs by heat generated from the LEDs.

An example of LED lighting device includes a metallic heat sink, which exhibits good heat dissipation efficiency and is attached to a lower side of a printed circuit board (PCB), to enhance heat dissipation efficiency.

For example, referring to FIG. 1, an LED lighting device includes a single PCB 100, a plurality of LED devices 110 mounted on the PCB 100, a heat sink 120 attached to a lower side of the PCB 100, and a case 130 covering the LED devices on the PCB 100.

In this LED lighting device, however, heat transfer from the LED devices to the heat sink is obstructed by the flexible PCB and a bonding agent located therebetween and having low thermal conductivity, and only a single heat sink is used for heat dissipation of all the LED devices, causing heat to concentrate at the center of the lighting device. As a result, the LED lighting device cannot effectively dissipate the large amounts of heat generated by high density LED devices, thereby increasing a likelihood of damaging the LED devices during light emission that involves heat generation.

As such, since multiple LED devices are mounted on a single substrate and are operated by DC power in the LED lighting device, the entire lighting device needs to be replaced, even if any one or a few of the LED devices in the lighting device are damaged.

Further, since the LED lighting device has a circuit structure in which the multiple LED devices are supported by a single PCB, the LED lighting device has a limit in realization of various structures and enables structure change only through production of new molds, which is uneconomical.

The foregoing discussion in this section is to provide general background information, and does not constitute an admission of prior art.

SUMMARY

Therefore, the present disclosure is directed to solving such problems of the related art and an aspect of the present disclosure provides a LED lighting device, which enables the assembly of one or more prefabricated water-resistant LED products in an attachable/detachable fixing frame in a variety of structures for use in a broad range of applications including street lights, security lighting, tunnel lights, floodlights, etc., and which allows convenient use of AC power without the need for an AC/DC adapter or a stabilizer.

In accordance with one embodiment of the present disclosure, a LED lighting device includes: a fixing frame having a plurality of LED seats disposed in a polygonal or circular arrangement; and one or more LED products assembled in the polygonal or circular arrangement to the respective LED seats of the fixing frame, wherein the LED products are operated by individual power sources and include individual heat sinks.

Each of the LED products may include an LED lamp having electric lines for receiving the power source, a heat dissipation member coupled to a lower side of the LED lamp to dissipate heat, for example, a heat dissipation member including a combination of a base plate and a heat dissipation block stacked one above the other, and a transparent cover coupled to an upper portion of the LED lamp to diffuse light, for example, a diffusing cover or a converging cover.

The LED lighting device according to the present disclosure has the following advantages.

Firstly, since the LED lighting device enables the assembly of one or more water-resistant LED products, the LED lighting device may be fabricated in a variety of structures for a broad range of applications, such as street lights, security lighting, tunnel lights, floodlights, etc.

Secondly, the LED lighting device enables adjustment of the number of LED lamps according to desired brightness.

Thirdly, the LED lighting device adopts a heat dissipation system which allows the respective LED lamps to dissipate heat individually and employs special heat dissipation fins, thereby providing excellent heat dissipation efficiency and extending lifespan of the LED lamps, namely, lifespan of the LED lighting device.

Fourthly, the LED lighting device allows easy adjustment of a diffusion range of light through arrangement of the LED lamps in various ways.

Fifthly, since the LED lighting device uses AC power, the LED lighting device may be conveniently used without the need for an AC/DC adapter or a stabilizer and may also be applied to any existing lighting device.

Sixthly, each of the LED products is treated with water-resistant silicone or the like, thereby providing superior durability against leaked water or moisture.

DETAILED DESCRIPTION OF EMBODIMENTS

According to an embodiment of the present disclosure, AC powered LED lamps are fabricated into independent water-resistant LED products by providing a power connector to each of the LED lamps and by assembling a metallic heat sink and a water-resistant cover, which is made of transparent plastics and may adjust a diffusion range of light, to lower and upper sides of the LED lamp for individual heat dissipation, respectively. Furthermore, one or more prefabricated water-resistant LED products are assembled in an attachable/detachable fixing frame in a variety of structures for application to any existing lighting case, instead of mounting several LEDs on a single PCB.

Thus, the LED lighting device may be used in a broad range of applications including street lights, security lighting, tunnel lights, floodlights, etc., and may use AC power without the need for an AC/DC adapter or a stabilizer.

Next, a LED lighting device according to one embodiment of the present disclosure will be described in more detail.

Figure 1:
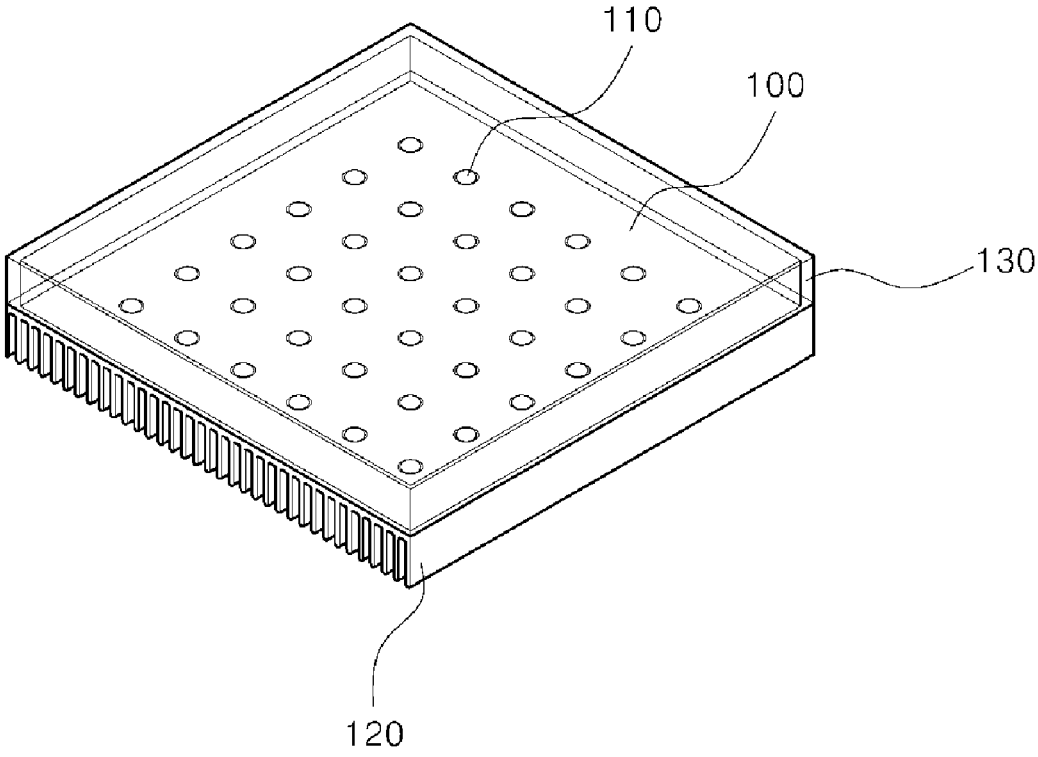
FIG. 1 is a perspective view of a LED lighting device.
Figure 2:
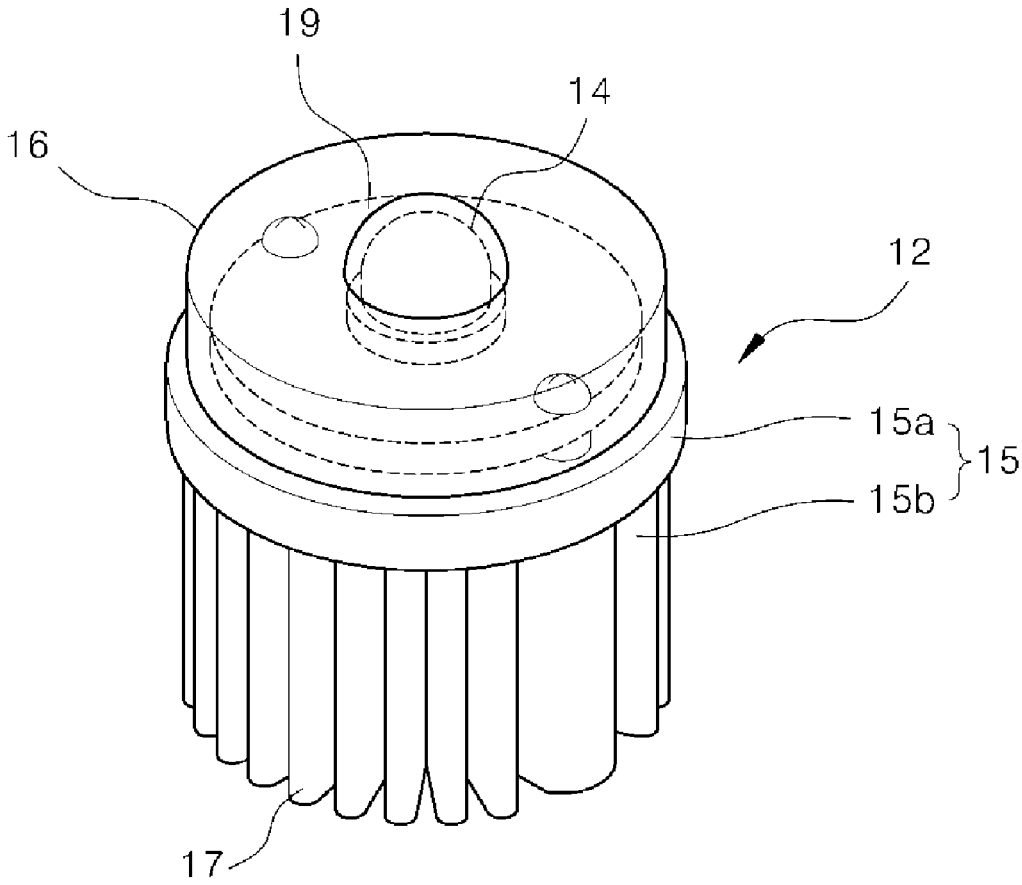
FIG. 2 is a perspective view of an LED product for a LED lighting device in accordance with one embodiment of the present disclosure.
Figure 3:
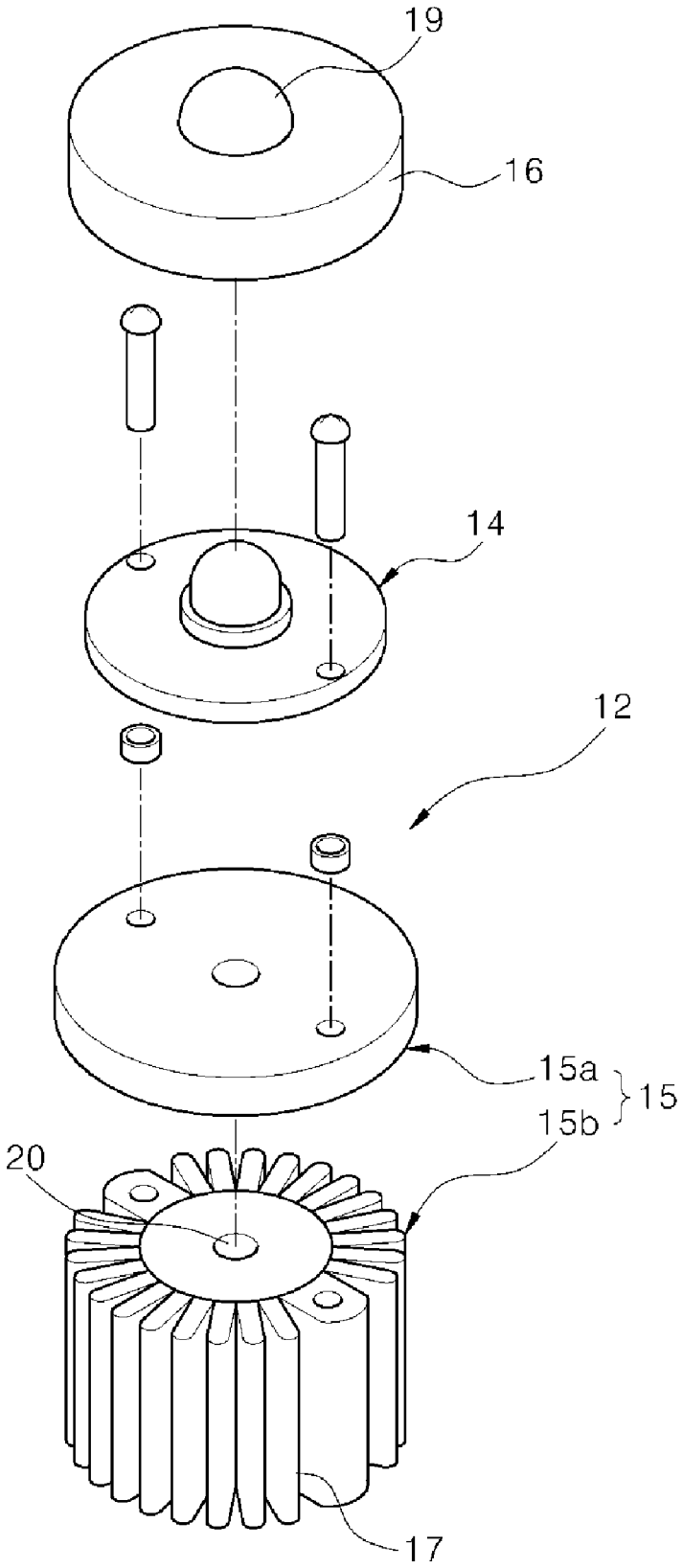
FIG. 3 is an exploded perspective view of the LED product of the LED lighting device in accordance with the embodiment of the present disclosure.

FIGS. 2 and 3 are a perspective view and an exploded perspective view of an LED product of a LED lighting device in accordance with an embodiment of the present disclosure.

Referring to FIGS. 2 and 3, the LED lighting device includes one fixing frame 11 and one or more LED products 12.

The fixing frame 11 includes a plurality of LED seats 10 disposed in a polygonal or circular arrangement. For example, the LED seats 10 may be disposed in a linear arrangement such as a transverse arrangement, a longitudinal arrangement, etc., a triangular arrangement, a rectangular arrangement, a pentagonal arrangement, a hexagonal arrangement, a circular arrangement, an elliptical arrangement, and other arrangements. On each of the LED seats 10, a single LED product 12 may be individually mounted.

In this manner, since the LED products 12 can be mounted in various arrangements, it is possible to optimize space utilization. Furthermore, when using the LED lighting device as a signboard or the like, the LED products 12 may easily be disposed, as needed, according to the number of characters to be displayed.

The LED product 12 is a kind of LED module, which includes an LED device, a substrate, an electrode pattern, etc., and may be formed by integrally assembling a transparent cover 16 and a heat dissipation member 15 to upper and lower sides of an LED lamp 14, respectively.

The LED lamp 14 uses AC power and is provided with two electric lines 13 for receiving power. Here, the electric lines 13 may be extended to an outside through a hole 20 of the heat dissipation member 15 described below, for example, a hole penetrating central portions of a base heat dissipation plate and a heat dissipation block.

The heat dissipation member 15 serves to dissipate heat, which is generated during operation of the LED lamp, to the outside, and is formed by laminating two metallic members one above the other. For example, the heat dissipation member 15 includes a disc-shaped base heat dissipation plate 15*a* coupled to a lower side of the LED lamp 14 and a heat dissipation block 15*b* directly coupled to a lower side of the base heat dissipation plate 15*a*.

In this manner, the LED lighting device may realize an individual heat dissipation system which provides one heat dissipation member 15 to each of the LED products 12, thereby guaranteeing superior heat dissipation efficiency. Namely, the individual LED products 12 perform independent heat dissipation while preventing heat from being transferred to other LED products adjacent the individual LED products 12.

Here, the heat dissipation block 15*b* is a cylindrical block that has a hole 20 at a center thereof. In particular, the heat dissipation block 15*b* has a plurality of heat dissipation fins 17 disposed in a predetermined arrangement around an outer circumferential surface thereof to provide as large a contact area as possible, thereby promoting cooling through active heat transfer to air. For example, the heat dissipation fins 17 are radially arranged along the circumferential surface of the heat dissipation block 15*b*.

In one embodiment, the heat dissipation fin may have an irregular surface to increase a surface area thereof.

Further, a heat dissipation layer may be formed in a gap between the LED lamp 14 and the base heat dissipation plate 15*a* filled with a heat dissipation material 18 such as heat dissipation silicone, such that heat is directly transferred from the LED lamp 14 to the heat dissipation member 15 via the heat dissipation layer.

The heat dissipation member 15 may be integrally assembled to the LED lamp 14 through screw fastening at two or more portions of the LED lamp 14.

The transparent cover 16 which serves as a protective cover and is formed of transparent plastics for diffusion of light is coupled to the LED lamp so as to completely cover the LED lamp 14. The transparent cover 16 may be assembled thereto by fastening, bonding or press-fitting.

The transparent cover 16 has a dome-shaped lamp receiving part 19 protruding upwardly at a center thereof, so that a lamp element of the LED lamp 14 is seated in the lamp receiving part 19.

In particular, two types of transparent cover 16 may be applied to the LED lamp depending on the function of the transparent cover, that is, diffusion of light or convergence of light. This can be achieved by varying the thickness of the lamp receiving part 19.

Figure 4:
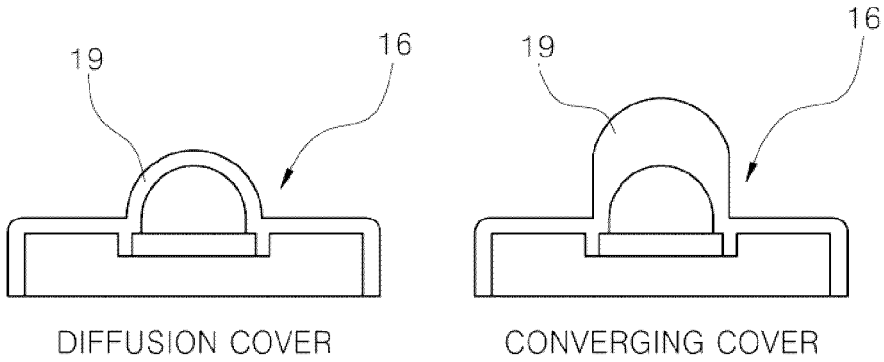
FIG. 4 is side-sectional views of a diffusion cover and a converging cover of the LED lighting device in accordance with the embodiment of the present disclosure.

For example, as shown in FIG. 4, the lamp receiving part 19 is formed to an average thickness of the cover, that is, the same thickness as that of the cover, such that the transparent cover 16 serves as a diffusing cover. Alternatively, the lamp receiving part 19 is formed thickly like a convex lens, that is, thicker than the cover, such that the transparent cover serves as a converging cover.

Next, a process of manufacturing the LED lighting device will be described.

First, electric lines are soldered to a substrate for each AC powered LED.

Then, each of the soldered electric lines is inserted into holes at centers of a base heat dissipation plate and a heat dissipation block through the back side of the substrate, and a heat dissipation material (for example, heat dissipation silicone or the like) is provided to a gap between the substrate of the AC powered LED lamp and the heat dissipation plate. Then, the base heat dissipation plate, the heat dissipation block and the LED lamp are assembled to one another using washers and screws.

Next, a heat dissipation material (for example, heat dissipation silicone or the like) is coated on the body of the assembled product, then a water-resistant transparent cover for diffusion or convergence of light, selected according to use of a final lighting device, is coupled to the product, followed by drying to provide an individual water-resistant LED product.

Figure 5:
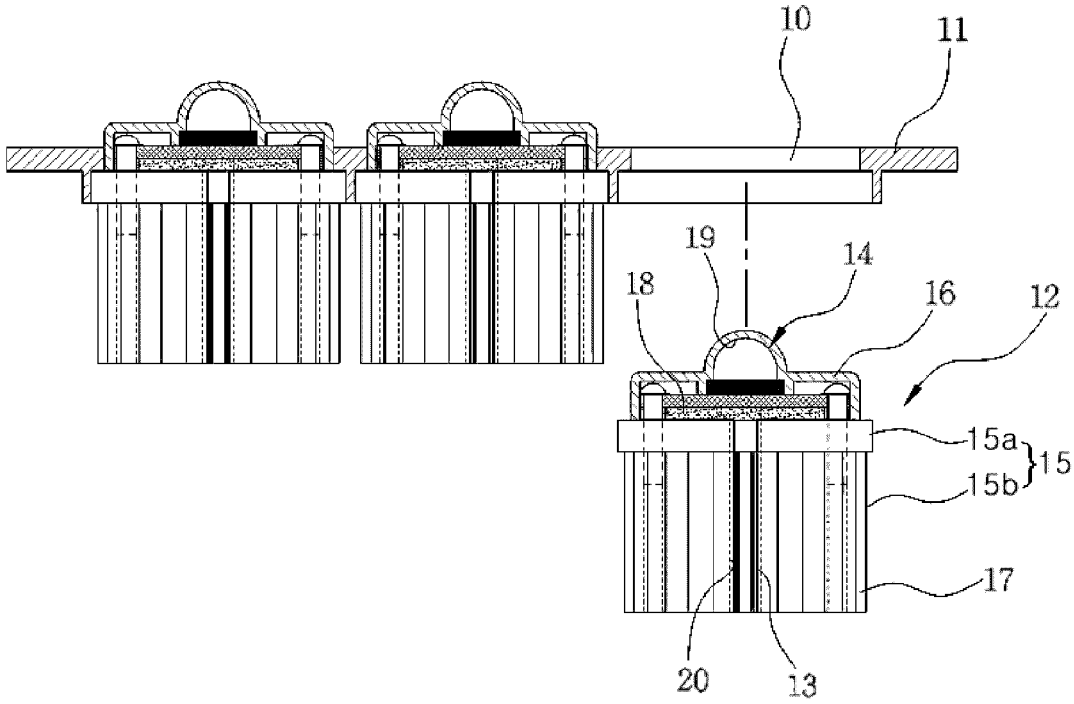
FIG. 5 is a side-sectional view of the LED lighting device in accordance with the embodiment of the present disclosure.

Next, as shown in FIG. 5, each of the water-resistant LED products is mounted on one of the LED seats of a fixing frame to provide a final LED lighting device.

Figure 6:
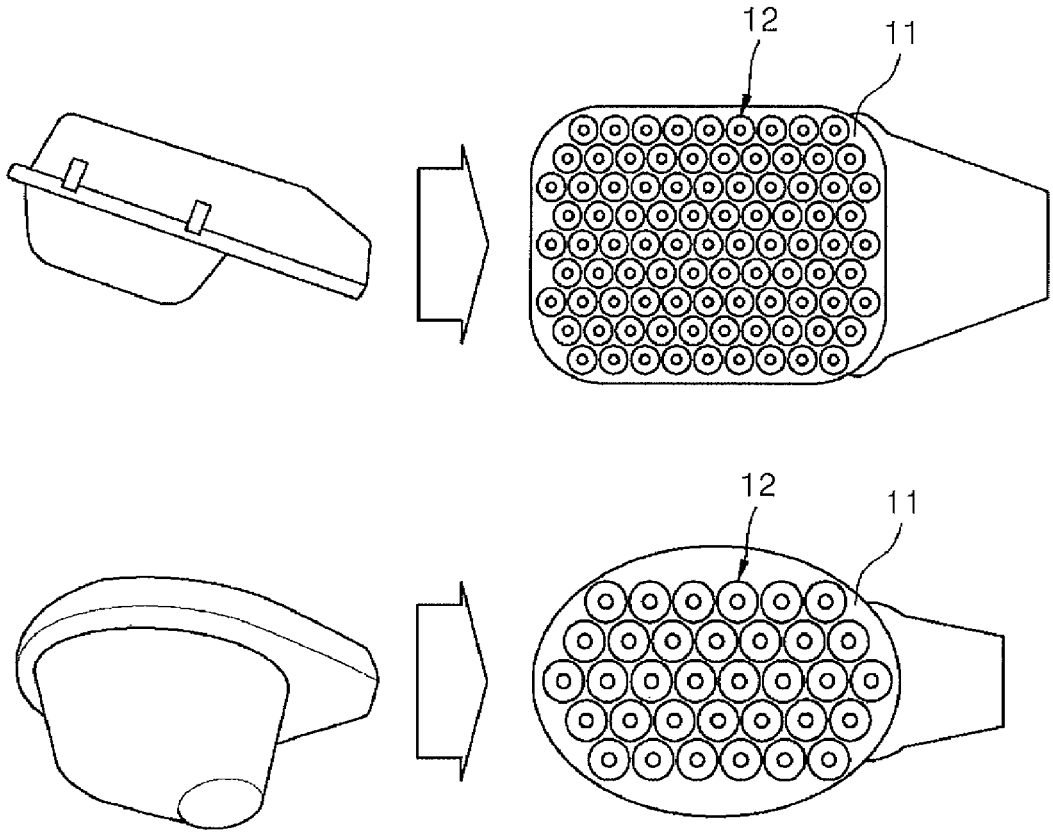
FIG. 6 is a schematic view of examples of the LED lighting device in accordance with the embodiment of the present disclosure.

Next, as shown in FIG. 6, the fixing frame including the individual water-resistant LED products is installed in an existing lighting device to provide a final LED lighting device.

Although various embodiments of the present disclosure have been described above, it will be apparent to a person having ordinary knowledge in the art that various changes, substitutions and alterations can be made without departing from the spirit and scope of the invention, as defined by the accompanying claims.

According to the present disclosure, the LED lighting device enables the assembly of one or more water-resistant LED products, and thus may be fabricated in a variety of structures for a broad range of applications including street lights, security lighting, tunnel lights, floodlights, etc. In addition, the LED lighting device enables adjustment of the number of LED lamps according to desired brightness. Further, the LED lighting device adopts a heat dissipation system which allows the respective LED lamps to dissipate heat individually and employs special heat dissipation fins, thereby providing excellent heat dissipation efficiency and extending lifespan of the LED lamps, namely, lifespan of the LED lighting device. Further, since the LED lighting device allows easy adjustment of a diffusion range of light through arrangement of the LED lamps in various ways and uses AC power, the LED lighting device may be conveniently used without the need for an AC/DC adapter or a stabilizer and may also be applied to any existing lighting device. Furthermore, each of the LED products is treated with water-resistant silicone or the like, thereby providing superior durability against leaked water or moisture.

What is claimed is:

1. A lighting device comprising:

a frame comprising a plurality of seats; and one or more light emitting diode (LED) modules, each of which comprises a heat sink that comprises a bare plate and a block coupled to the lower side of the LED, wherein the block has a plurality of fins formed on an outer circumferential surface thereof and at least one LED and a diffusion cover coupled to the LED, wherein each module is received in one of the plurality of seats so that the LED and the heat sink are supported by the seats in the frame; and one or more AC power sources, each of which is configured to supply power to one of the LED modules.

2. The lighting device of claim 1, wherein a gap between the lower side of the LED and an upper side of the base plate is filled with a heat dissipation material.

3. The lighting device of claim 1, wherein the diffusion cover comprises a dome-shaped portion having a recess configured to receive at least a portion of the LED.

4. The lighting device of claim 1, wherein the plurality of seats are arranged such that the heat sinks of two neighboring LED modules are spaced from each other.

* * * * *